US008517231B2

(12) United States Patent
Hackl et al.

(10) Patent No.: US 8,517,231 B2
(45) Date of Patent: Aug. 27, 2013

(54) IMMERSION NOZZLE

(75) Inventors: Gernot Hackl, Trofaiach (AT); Gerald Nitzl, Bocholt (DE)

(73) Assignee: Refractory Intellectual Property GmbH & Co. KG, Vienna (AT)

( * ) Notice: Subject to any disclaimer, the term of this patent is extended or adjusted under 35 U.S.C. 154(b) by 156 days.

(21) Appl. No.: 13/129,549

(22) PCT Filed: Oct. 29, 2009

(86) PCT No.: PCT/EP2009/007731
§ 371 (c)(1),
(2), (4) Date: May 16, 2011

(87) PCT Pub. No.: WO2010/057566
PCT Pub. Date: May 27, 2010

(65) Prior Publication Data

US 2011/0233237 A1 Sep. 29, 2011

(30) Foreign Application Priority Data

Nov. 22, 2008 (DE) ..... 10 2008 058 647

(51) Int. Cl.
*B22D 41/08* (2006.01)

(52) U.S. Cl.
USPC ..... 222/606; 222/594; 164/437

(58) Field of Classification Search
USPC ..... 222/606, 607, 566, 594; 164/437
See application file for complete search history.

(56) References Cited

U.S. PATENT DOCUMENTS

| | | | | | |
|---|---|---|---|---|---|
| 3,349,838 | A | * | 10/1967 | Baier | 164/437 |
| 3,669,181 | A | | 6/1972 | Schrewe | |
| 4,487,251 | A | * | 12/1984 | Cahoon et al. | 164/475 |
| 4,779,775 | A | | 10/1988 | Kimura et al. | |
| 5,429,283 | A | | 7/1995 | Luehrsen et al. | |
| 6,095,233 | A | * | 8/2000 | Leabeater et al. | 164/480 |
| 6,336,575 | B1 | | 1/2002 | Schemeit et al. | |

FOREIGN PATENT DOCUMENTS

| | | | |
|---|---|---|---|
| DE | 1508761 | A1 | 11/1969 |
| DE | 1959097 | B1 | 11/1970 |
| DE | 4317620 | C1 | 8/1994 |
| DE | 3628066 | C2 | 10/1994 |
| DE | 19722890 | A1 | 12/1998 |
| EP | 0630712 | A1 | 12/1994 |
| EP | 1036613 | B1 | 8/2003 |
| FR | 2227728 | * | 12/1974 |
| WO | 0166286 | A1 | 9/2001 |

OTHER PUBLICATIONS

Zhang et al., "Physical, Numerical and Industrial Investigation of Fluid Flow and Steel Cleanliness in the Continuous Casting Mold at Panzhihua Steel", AIS Tech 2004, Sep. 15, 2004, pp. 879-894 (1-16), Association Iron Steel Technology, Warrendale, PA (US).

* cited by examiner

*Primary Examiner* — Scott Kastler
*Assistant Examiner* — Michael Aboagye
(74) *Attorney, Agent, or Firm* — Christopher L. Parmelee; Walker & Jocke

(57) ABSTRACT

The invention relates to an immersion nozzle, for example of the kind used for continuously casting a metal melt.

7 Claims, 2 Drawing Sheets

IMMERSION NOZZLE

The invention relates to an immersion nozzle (also called submerged entry nozzLe), for example of the kind used for continuously casting a metal melt.

BACKGROUND

EP 1 036613 B1 discloses the basic structural design of such an immersion nozzle. The immersion nozzle encompasses a tubular body and a pouring channel, which extends from a first end section of the tubular body, where a metal melt enters the pouring channel, to a second end section, where the metal melt exits the pouring channel via at least one outlet opening. As evident from the publication, immersion nozzles, with two diametrically opposed lateral outlet openings are encompassed by prior art, so that the melt is laterally diverted in two directions from an initially purely vertical flow direction before exiting the Immersion tube.

In generic nozzles, it is known to supply an inert gas like argon to the metal melt, for example so is to prevent so-called "clogging", i.e., to prevent growths from narrowing the cross section of the pouring channel.

The disadvantage to this process is that gas bubbles of significant size form in part, and are entrained in the metallurgical molten bath with the melt stream. Such gas bubbles can exhibit a diameter of several millimeters, but at times diameters in the centimeter range as well.

As soon as the melt is transferred from the immersion tube into the molten bath of the metallurgical vessel (for example, an ingot mold of a continuous casting system), especially large gas bubbles bubble up in the molten bath, but additional problems are here encountered as well:

- Turbulences arise in the transitional area between the immersion tube and the melt bath, negatively influencing wear of the immersion tube;
- The casting level (surface of the melt bath) can fluctuate, in particular in the contact zone relative to the immersion tube;
- The slag can foam;
- Rising gas bubbles can break up a slag layer lying on the melt bath and/or a casting powder layer. The melt may undesirably come into contact with the ambient air in the process. Slag can also be drawn into the melt.

Zhang et. al. "Physical, Numerical and Industrial Investigation of fluid Flow and Steel Cleanliness in the Continuous Casting Mold at Panzhihua Steel" describe the flow conditions in immersion tubes when gas is injected in AIS Tech 2004, Nashville (US), Sep. 15-17, 2004, Association Iron Steel Technology, Warrendale, Pa. (US), 879-894. Under certain operating conditions, gas and melt separate. This yields in part very large gas bubbles, which exit the immersion tube and penetrate into the melt.

SUMMARY

The object of the invention is to eliminate these disadvantages, and to offer an immersion nozzle that permits, as far as possible, transport of a metal melt in a metallurgical melting vessel without, problems, even if the melt contains gas bubbles.

In order to achieve this object, the invention proceeds from the following idea:

The described formation of gas bubbles, including larger gas bubbles, mostly can not be prevented. To the contrary, it is metallurgically necessary for certain applications. The concept according to the invention involves making the existing gas bubbles as harmless as possible. In addition, the invention is based on the idea of providing a way to remove the gas bubbles form the molten stream before the metal melt is routed out of the immersion tube and into a molten metal bath of a metallurgical melting vessel.

The invention here relies on the fact that gas bubbles within a metal melt rise (float up). The larger the gas bubbles and the lower the viscosity of the metal melt, the greater the tendency of the gas bubbles to rise. In other words, in particular the undesirably large gas bubbles with a diameter of >1 mm are easier to remove from the melt than small gas bubbles.

Against this backdrop, the specific idea of the invention is in providing a chamber just before the melt exits the immersion tube, in which these types of gas bubbles can rise (escape). The chamber acts as a collecting tank or buffer vessel for the mentioned gas bubbles before the latter get into the metal bath (the ingot).

Additional considerations relating to the invention involve either returning this gas/these gas bubbles to the melt stream within the immersion tube, specifically in such a way as to comminute the gas bubbles as they are introduced in the melt stream, thereby rendering them largely harmless, or remove the gas from the system in an alternative embodiment, meaning into the ambient atmosphere.

In its most general embodiment, the invention hence relates to an immersion nozzle with the following features:

1.1 A tubular body;

1.2 A pouring channel that extends from a first end section of the tubular body where a metal melt enters the pouring channel to a second end section where the metal melt exits the pouring channel via at least one outlet opening;

1.3 At least one chamber in the area of the second section, which runs behind the respective outlet opening in the direction of flow of the metal melt, and extends towards the first end section.

An immersion nozzle with the features 1.1 and 1.2 is prior art, which will now be optimized by the structural design of feature 1.3.

In an immersion nozzle of the kind known from EP 1 036 613 B1 cited above, the melt in the pouring channel at first runs vertically from the top downwards, before it is divided and runs but of the immersion, nozzle via two diametrically opposed lateral outlet openings at an angle: of about 60°.

The invention now provides a chamber at the second end section of the immersion nozzle, said chamber being in fluid connection with the pouring channel, so that gas bubbles transported within the melt stream, can rise from the melt stream into the chamber thereby being removed from that part of the melt that flews into the metallurgical melting vessel or its metal bath respectively.

The emphasis is here placed on removing especially large gas bubbles, meaning gas bubbles with a diameter of several millimeters (up to the centimeter range), for example, from the system, because these gas bubbles disrupt the process in a special way, as described above.

The melt stream as such and the flow direction of the melt remain largely unchanged relative to prior art.

The chamber can originate from a section of the pouring channel along which the metal melt flows at an angle of >0 and <90° relative to the axial direction of the tubular body. If the flow conditions in the metallurgical vessel permit, the angle can also be ≧90°, enhancing the tendency of gas bubble separation.

In the mentioned example, this would be the section in which the metal melt is diverted from the vertical flow direction laterally to the outlet openings.

The chamber may follow the pouring channel essentially radially outwardly, so that the limiting wail of the pouring channel forms an inner wail of the chamber.

The collecting space for the gas can also run annularly around the pouring channel, or consist of several chambers, spaced apart from each other.

With respect to the embodiment of an immersion nozzle according to EP 1 036 613 B1, for example, two chambers are preferably provided, wherein each chamber is allocated to one of two melting streams at the outlet side end.

The invention further provides at least one additional connecting area (an opening) to the pouring channel at a distance to the first connecting area with the pouring channel thereby imparting a kind of bypass function to the chamber. Gas bubbles that have risen to the top in the chamber from, its lower end (viewed in the primary direction of flow of the melt) can be returned to the pouring channel, and hence into the melt stream, at the upper end of the chamber, meaning the end of the chamber facing the first end section of the pouring channel. It was here discovered that, when returning the relatively large gas bubbles into the melt stream, the gas bubbles are comminuted to a scale that causes the least damage. In other words, the gas is not removed form the system in this embodiment; however, the gas bubbles are comminuted to a scale where they no longer pose the cited problems in the metallurgical vessel, even after entering into the molten bath. Rather, the comminuted gas bubbles can then slowly rise, without turbulence and any destruction of slag and casting powder layer.

According to another embodiment the chamber provides an opening at a distance to its lower end meaning offset towards the first end section of the immersion nozzle, which opening provides a connection to the ambient atmosphere during proper use of the immersion nozzle.

In a typical application of the kind described in EP 1 036 613 E1, this means that the opening is arranged above the slag level or above a casting powder level, and in any case above the molten metal bath, when the immersion nozzle is in the mounted position. Therefore, in this embodiment, the gas is routed out of the area of the immersion nozzle into the ambient atmosphere.

The pouring channel itself and its shape, in particular in the second end section towards the outlet opening or outlet openings can be designed according to prior art. It is advantageous for the pouring channel to be designed in the second section in such a way that the metal melt flows out of the outlet opening at an angle >0 and <90° relative to the axial direction of the tubular body, since this calms the melt stream, and the gas bubbles can still rise towards the top sufficiently.

The mentioned flow angle can be limited to >45° and <75° in another embodiment.

The immersion nozzle can be manufactured with conventional processes, and using refractory materials, for example as a casted or pressed workpiece, made of a batch based on $Al_2O_3$, $TiO_2$, $ZrO_2$, MgO, CaO, etc.

The size of the chamber depends on the application in question. The transition area. (opening area) between pouring channel and chamber will normally exhibit a cross sectional area of 7-30 $cm^2$, and the chamber as a whole a volume of 50-250 $cm^3$, for example, in connection with an immersion nozzle having a length of 900 mm, an outer diameter of 120 mm, a pouring channel diameter of 70 mm and a cross sectional area of the outlet opening(s) of approx. 50 $cm^2$.

Any directions indicated in this specification and the claims relate to a functional position of the immersion nozzle during, use as intended.

Other features of the invention arise from the features in the subclaims, as well as any other application documents.

BRIEF DESCRIPTION OF THE DRAWINGS

The invention will be described in greater detail below based on two exemplary embodiments, wherein FIGS. 1 and 2 each show a schematic view of an outlet side (second) end of an immersion nozzle according to the invention, on the left on FIG. 1, while prior art is presented on the right.

Components that are identical or operate the same are labeled, with the same reference numbers on the figures.

DETAILED DESCRIPTION

Figure 1:
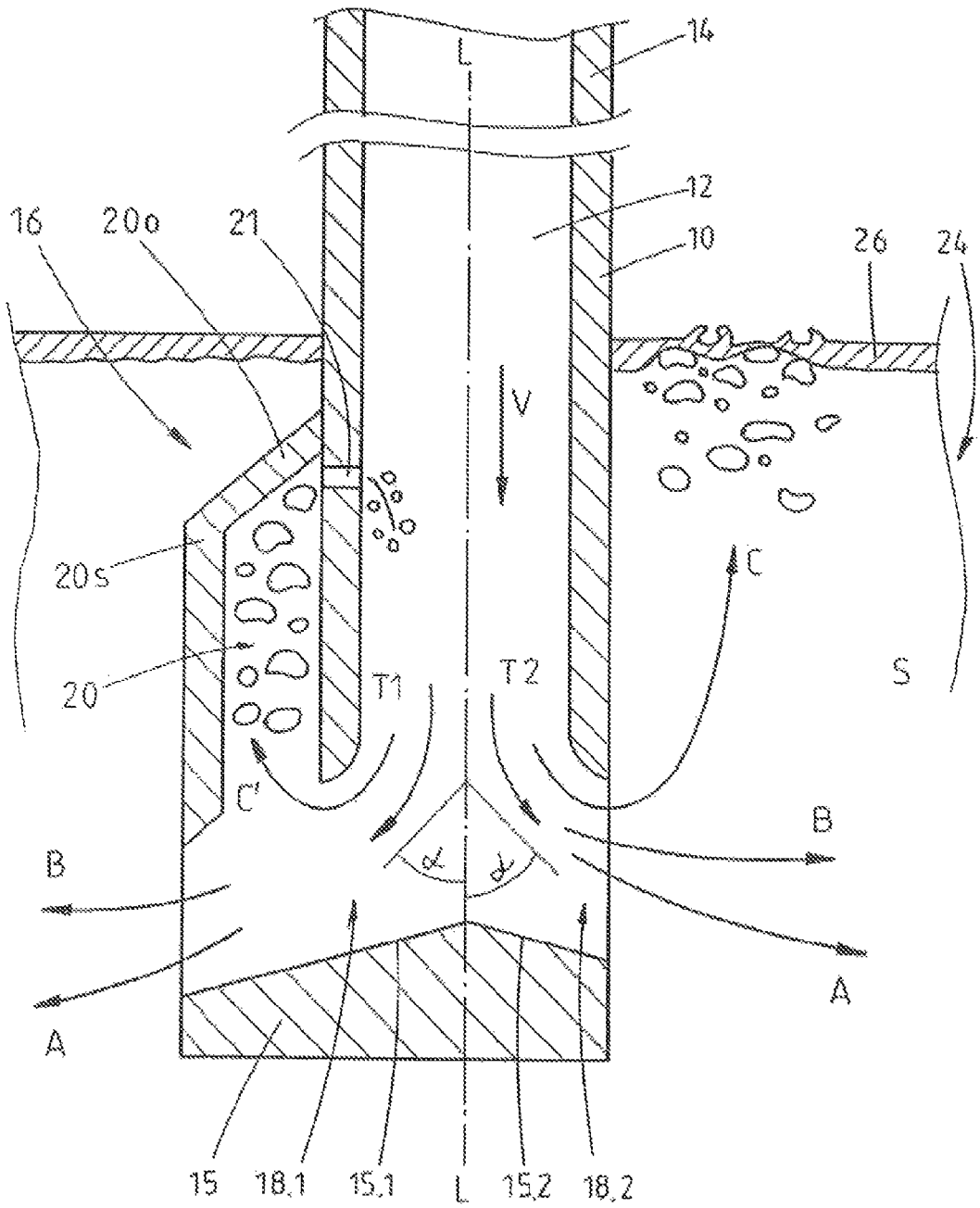

FIG. 1 shows an immersion nozzle with a tubular body 10, a pouring channel 12, which extends essentially concentrically to the axial central longitudinal axis L of the tubular body, specifically from a first end section 14 of the tubular body, where a metal melt enters the pouring channel, to a second end section 16, where the metal melt exits the pouring channel 12 via two lateral outlet openings 18.1, 18.2.

The pouring channel 12 is designed in the area of the second end section 16 in such a way that the metal melt changes its original purely vertical direction of flow (arrow V), and the melt stream splits into two partial flows (arrows T1, T2), which initially run at an angle α of about 50° relative to the direction of flow V towards the outlet openings 18.1, 18.2.

This change in direction is supported by an end-side faceplate 15 of the immersion nozzle with oppositely slanted inclined surfaces 15.1, 15.2. This all represents prior art, and is shown in the right portion of FIG. 1.

The melt stream entrains gas bubbles, for example from an inert gas treatment of the melt, wherein these gas bubbles can exhibit a varying size. This is diagrammatically denoted in the right portion of FIG. 1 by arrows A, B, and C, wherein G depicts a typical direction of flow for larger gas bubbles, B a typical direction of flow for medium-sized gas bubbles, and A the direction in which the smallest gas bubbles are routed into the melt bath S. In other words, while smaller to medium-sized gas bubbles are distributed more or less homogeneously in the melt bath S, the larger gas bubbles, especially those with a diameter exceeding 1 mm, rise in the molten bath S, causing the metallurgical problems specified above. For example, these larger gas bubbles can break up a slag layer 26 lying on the molten bath and/or a casting powder layer, as also, denoted, diagrammatically in the right portion of FIG. 1.

The immersion nozzle according to the invention is distinguished from this prior art by the geometry shown on the left of FIG. 1:

The immersion tube is outwardly expanded at opposing areas of the lower end section 16 by a respective chamber 20, which is bordered by an upper wall surface 20*o*, an outer and lateral adjoining wall surface 20*s* that runs parallel to the body 10, and a part of the body 10, and is open to the bottom (toward the faceplate 15). In the upper area of the chamber 20, adjacent to the upper wall 20*o*, body 10 has an opening 21 that provides a flow connection between the interior of the body 10 (the pouring channel 12) and chamber 20.

While the melt stream is discharged laterally from the immersion nozzle at the lower end of the immersion nozzle at 18.1, 18.2 as in prior art, wherein the finest gas bubbles are essentially entrained similarly in arrow direction A, and medium sized gas bubbles in arrow direction B as described before, the chamber 20 makes it possible to how prevent gas bubbles from rising in the molten bath S and destroying, a slag or casting powder layer, instead trapping them in the chamber 20 as denoted by arrow C'. These, large gas bubbles then pass through the opening 21 and return to the melt stream in the second end section 16 of the body 10, where the gas bubbles are comminuted by the casting jet stream, as diagrammatically denoted by smaller circles in the area of opening 21.

These newly comminuted (smaller) gas bubbles, e.g. argon bubbles, are then entrained with the melt stream again in arrow direction V, and Introduced via the outlet opening 18.1 (and similarly given a corresponding design on the other side via outlet opening 18.2) into the molten bath S of the metallurgical vessel 24, specifically according to arrow directions A and B.

Figure 2:
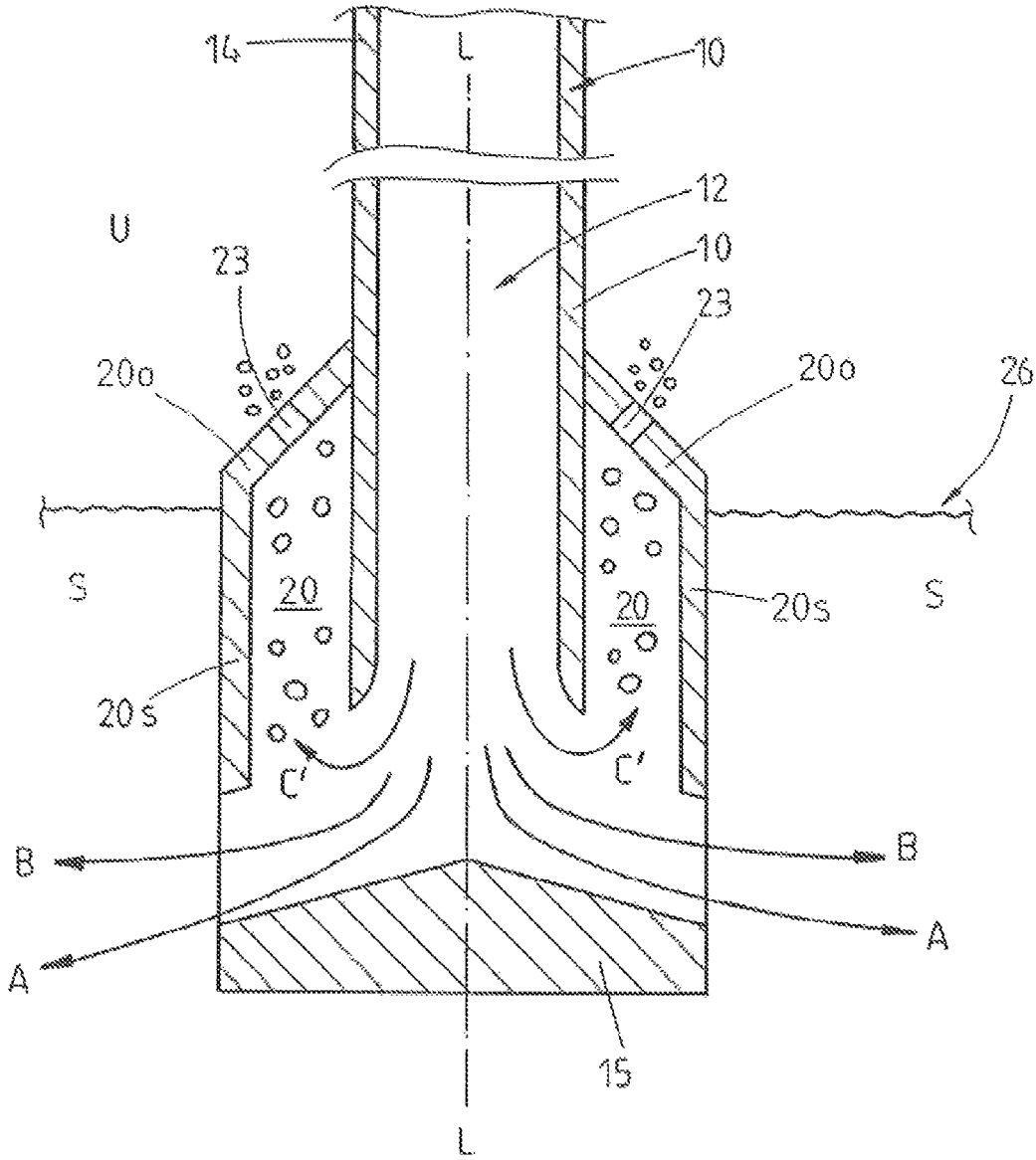

The embodiment according to FIG. 2 differs, from the embodiment according to FIG. 1 in that the opening (s) 21 between the chamber(s) 20 and pouring channel 12 in the upper wall Section 20*o* of the chambers 20 is/are replaced by gas outlet openings 23 through which the gas bubbles can escape into the ambient atmosphere U, as also diagrammatically denoted by circles.

In the embodiment shown on FIG. 2, the immersion nozzle is dimensioned in such a way that the upper limiting wall 20*o* of each chamber 20 runs above the molten bath S or corresponding slag or casting powder layer 26, so that the gas bubbles, exiting via the gas outlet openings 23 can escape directly into the ambient atmosphere.

An immersion nozzle according to the invention includes the following features:

The immersion nozzle is designed as a one-piece component, meaning that the tubular body and chamber(s) are materially fit together, and can consist of the same refractory ceramic material.

The pouring channel cross section corresponds to the inner cross section of the tubular body. In a tubular body shaped like a circular cylinder (between the first and second end section), the cross section of the melt stream is also circular in this section.

Regularly there are no inserts or fittings in the tubular body.

The diversion area for the melt at the outlet-side at the second end section of the tubular body is an integral component of the immersion nozzle.

The chamber volume arid inner volume of the entire immersion tube do not chance during use (except for erosion).

As a rule, the immersion tube is designed in such a way that the melt flowing vertically from the top down is divided at the second end section into at least two spaced apart partial streams, each of which is allocated a chamber, which when viewed in the direction of flow of the melt each being arranged before the area where the melt stream or a portion thereof exits the immersion nozzle.

The invention claimed is:

1. An immersion nozzle with the following features:

1.1. A tubular body (10), 1.2. A pouring channel (12), which extends from a first end section (14) of the tubular body (10), where a metal melt enters the pouring channel (12), to a second end section (16), where the metal melt is diverted from a vertical flow direction laterally and exits the pouring channel (12) via at least one lateral outlet opening (18.1, 18.2), 1.3. At least one chamber (20) in the area of the second end section (16), which follows the pouring channel (12) radially outwardly, runs behind the respective lateral outlet opening (18.1, 18.2) in the flow direction of the metal melt, and extends towards the first end section (14) and 1.4 with at least one connecting opening (21) between the chamber (20) and the pouring channel (12), wherein the connecting opening is above the lateral outlet opening.

2. The immersion nozzle according to claim 1, wherein the chamber (20) essentially runs parallel to the pouring channel (12).

3. The immersion nozzle according to claim 1, wherein the chamber (20) proceeds from a section of the pouring channel (12), along which the metal melt flows at an angle >0 and <90 degrees relative to the axial direction of the tubular body (10).

4. The immersion nozzle according to claim 1, wherein the chamber (20) is bordered on the inside by the tubular body (10).

5. The immersion nozzle according to claim 1, wherein the opening (21) adjoins an upper end of the chamber (20).

6. The immersion nozzle according to claim 1, wherein the pouring channel (12) at its second end section is designed in such a way that the metal melt flows out of the outlet opening (18.1, 18.2) at an angle >0 and <90 degrees relative to the axial direction of the tubular body (10).

7. The immersion nozzle according to claim 1, wherein the pouring channel (12) at its second end section (16) is designed in such a way that the metal melt flows out of the outlet opening at an angle >45 and <75 degrees relative to the axial direction of the tubular body (10).

* * * * *